US009561840B2

(12) United States Patent
Dilling

(10) Patent No.: US 9,561,840 B2
(45) Date of Patent: Feb. 7, 2017

(54) FIN ASSEMBLY FOR WATER SPORTS BOARD

(76) Inventor: Klaus Feye Dilling, Dillon Beach, CA (US)

( * ) Notice: Subject to any disclaimer, the term of this patent is extended or adjusted under 35 U.S.C. 154(b) by 157 days.

(21) Appl. No.: 13/193,317

(22) Filed: Jul. 28, 2011

(65) Prior Publication Data

US 2012/0028523 A1 Feb. 2, 2012

Related U.S. Application Data

(60) Provisional application No. 61/368,926, filed on Jul. 29, 2010.

(51) Int. Cl.
*B63B 35/79* (2006.01)
*B63H 25/06* (2006.01)

(52) U.S. Cl.
CPC ..... *B63B 35/7926* (2013.01); *B63H 25/06* (2013.01)

(58) Field of Classification Search
CPC ..... B63B 35/7926; B63B 2035/715; B63H 25/06
USPC ..... 441/76, 79; 114/144 R
See application file for complete search history.

(56) References Cited

U.S. PATENT DOCUMENTS 2,910,708 A * 11/1959 Albright ..... B63B 35/81 114/162
4,603,648 A * 8/1986 Berge ..... 114/39.27
5,611,596 A * 3/1997 Barley ..... B60N 2/2806 297/256.13
6,579,134 B1 * 6/2003 Fiebing ..... A63C 5/03 440/14
7,108,571 B2 * 9/2006 Geraghty ..... 441/79
7,144,285 B1 * 12/2006 Hendricks ..... 441/74
8,083,560 B2 * 12/2011 Foulke ..... 441/79

FOREIGN PATENT DOCUMENTS

DE 4237819 A1 * 5/1994 ..... B63B 35/7926

* cited by examiner

*Primary Examiner* — Andrew Polay
(74) *Attorney, Agent, or Firm* — William C. Milks, III

(57) ABSTRACT

A water sports board, such as a surf board, is described which has a rider operated center fin that is rotatably mounted on the lower side of the board which aids in steering the board. The central fin is rotatably moved by a center fin assembly that includes a driving mechanism such as a tiller or arm secured to a rotatable shaft passing through the board that is secured to the rotatable central fin. The rider uses his or her rear foot to apply a force to the tiller or arm which moves the tiller and in turn moves the center fin so as to steer the board.

25 Claims, 13 Drawing Sheets

Fig. 2B
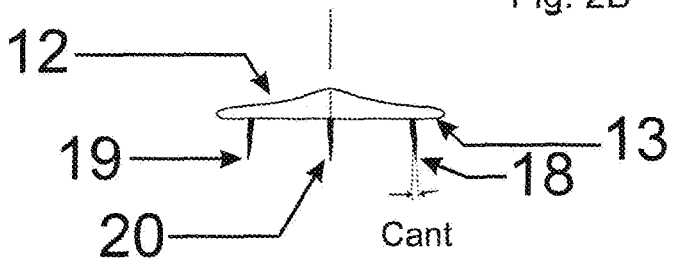
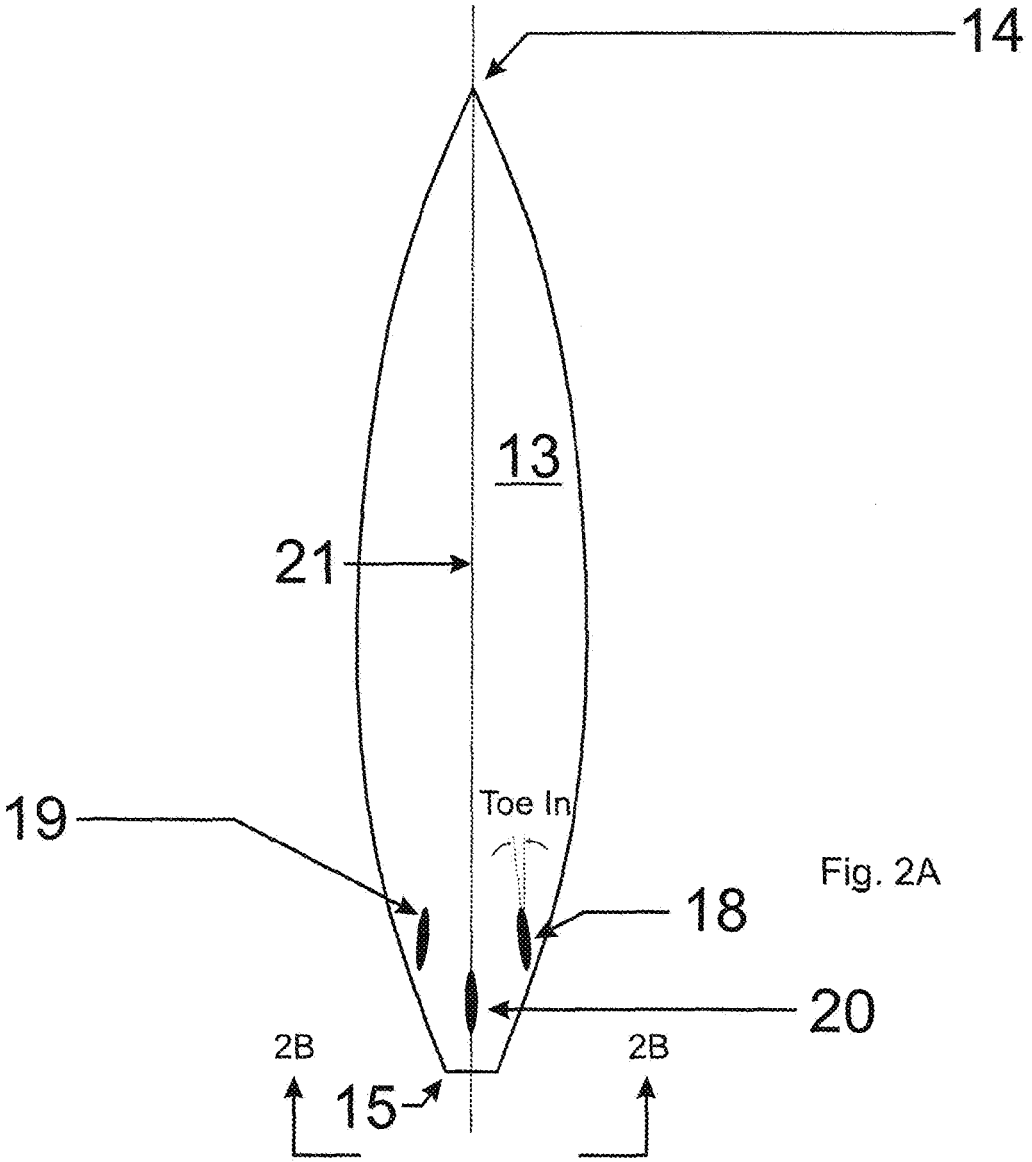
Fig. 2A

FIGURE 19
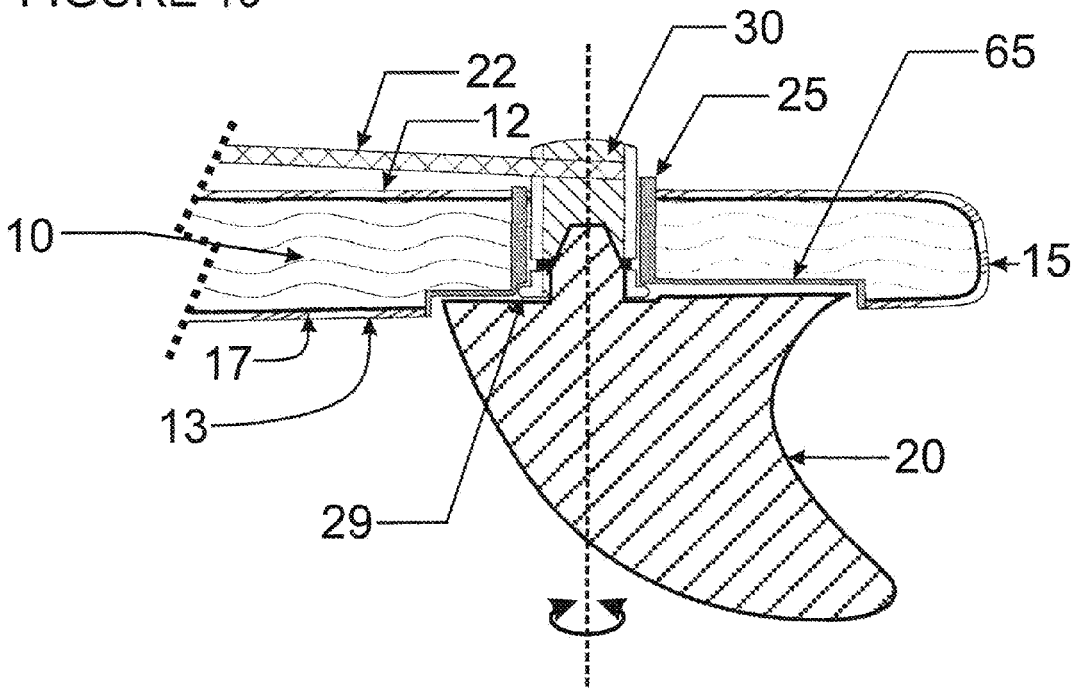
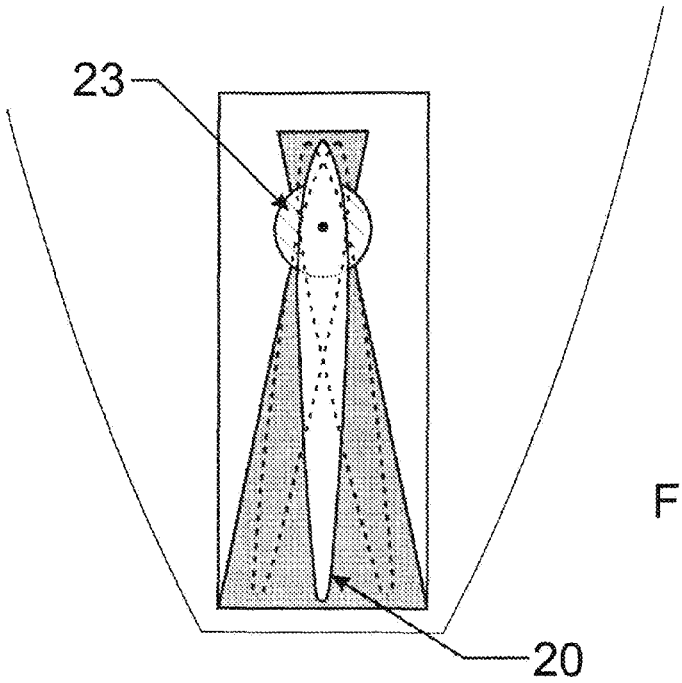
FIGURE 20

FIN ASSEMBLY FOR WATER SPORTS BOARD

RELATED APPLICATIONS

This application is related to and claims priority from provisional application Ser. No. 61/368,926, filed on Jul. 29, 2010, which is incorporated herein by reference in its entirety.

FIELD OF THE INVENTION

The invention is generally directed to water sports boards such as surfboards, kite boards and the like and specifically to an assembly for controlling a rudder or center fin on such a board.

BACKGROUND OF THE INVENTION

Surfboards and other water sport boards generally are elongated tapered boards having upper surfaces called a deck, lower surfaces and center line. The boards are configured to support a rider on their upper surfaces. Early surfboards had a single fin in an aft position mounted to the lower surface along a center line of the board. Most commercially available surfboards now have a triple fin arrangement, commonly referred to as the thruster, on the lower surface at the aft portion of the board. The three fin arrangement has a center fin mounted along the center line of the board and two other side fins are spaced away from the center line of the board and forward of the center fin. The two side fins are usually mounted to the board at an acute angle with respect to the center line, i.e. they tow in and they are frequently canted, i.e. inclined away from the center line.

SUMMARY OF THE INVENTION

The invention is directed to water sports board such as a surfboard and the like having a fin assembly which may be manipulated by the rider while riding the sports board.

A water sports board embodying features of the invention has a rotatable center fin which is manipulated by a rider on the upper surface to steer or otherwise control movement of the board. In one embodiment the board is provided center fin assembly which includes a rotatable shaft which passes through a passageway in the aft end of the board and which is secured to the center fin at the shaft's lower portion and a drive element such as a tiller or arm that is secured at its aft end to the rotating shaft of the center fin assembly which facilitates center fin movement. The tiller or arm is configured to be operable by the rider with his foot, such as the rider's rear positioned foot in the normal operation of the art of surfing.

The tiller may be flexible and preferably hinged at its forward end, and is aligned with the centerline axis of the board at a rear or aft location. The tiller aft end is in a substantially perpendicular orientation with respect to the axis of the rotatable shaft of the center fin assembly. The board has a passageway through which the center fin shaft extends. The passageway through the board is provided a sleeve configured to slidably receive the rotatable shaft of the center fin assembly and allow the shaft to rotate or move in response to the rider's manipulation of the shaft by the tiller or other drive mechanism.

The rotatable shaft preferably comprises upper and lower shaft portions which are joined together within the passageway through the board so as to effectively operate as a single unit and able to withstand the forces enacted upon it in the operation of the board. The upper segment of said fin shaft is connected to the aft end of the tiller; and the lower segment of the fin shaft is secured to the center fin or rudder of the board to facilitate the movement thereof. The center fin is thus made to rotate in a limited manner by the forceful initiation of a turning maneuver by the rider by applying a force to the tiller at an intermediate location between the forward and aft ends of the tiller to turn the rudder in the direction of the desired trajectory. Preferably, the tiller has an arch pad at the intermediate location having an upper surface with increased traction so the rider's foot can push off of the arch pad when executing a turn. The under surface of the arch pad is preferably provided with a low friction surface, e.g. TEFLON® or other suitable fluorocarbon material, so as to slide over the upper surface of the board. The arch pad is made to deflect with the tiller thereby turning the center fin of the board.

These and other advantages of the invention will become more apparent from the following detailed description of embodiments when taken in conjunction with the accompanying exemplary drawings.

BRIEF DESCRIPTION OF THE DRAWINGS

FIG. 2A is a bottom view of the surfboard shown in FIG. 1.

FIG. 2B is an end view of the surfboard shown in FIG. 2A taken along lines 2B-2B.

FIG. 19 is a longitudinal cross section of an alternative center assembly embodying features of the invention in which the outer sleeve has an integral fin box configured to allow the rotation of the center fin base.

FIG. 20 is a bottom view of the center fin and fin box shown in FIG. 19 illustrating rotation of the center fin.

DETAILED DESCRIPTION OF EMBODIMENTS OF THE INVENTION

Figure 1A:
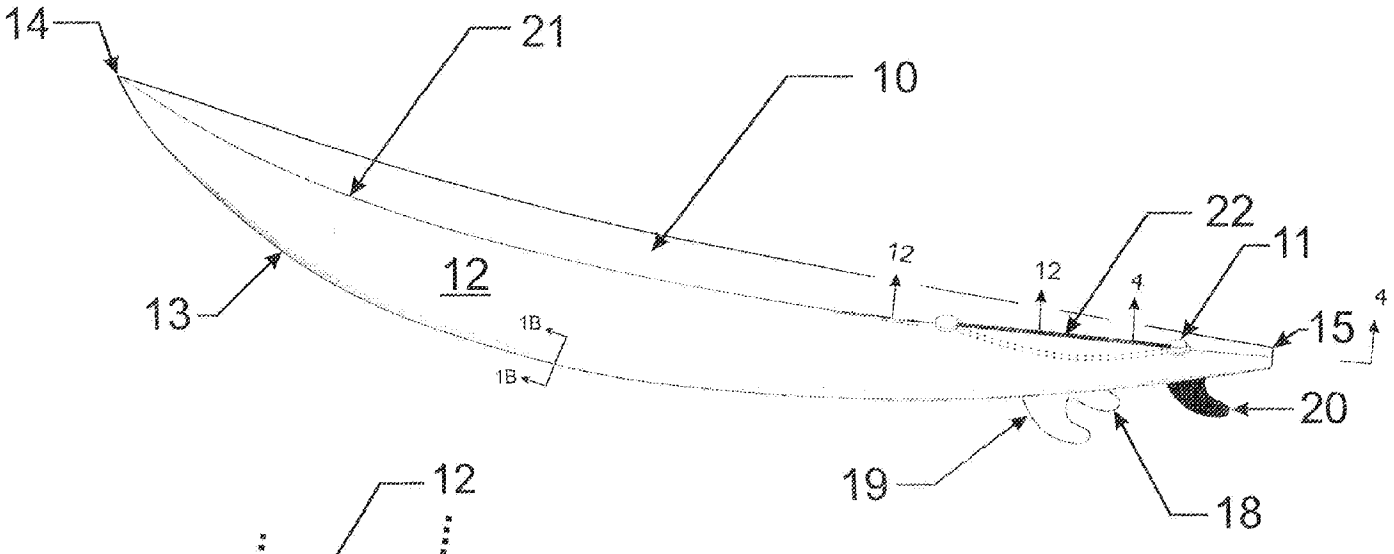
FIG. 1A is an upper perspective view of a surf board embodying features of the invention.
Figure 1B:
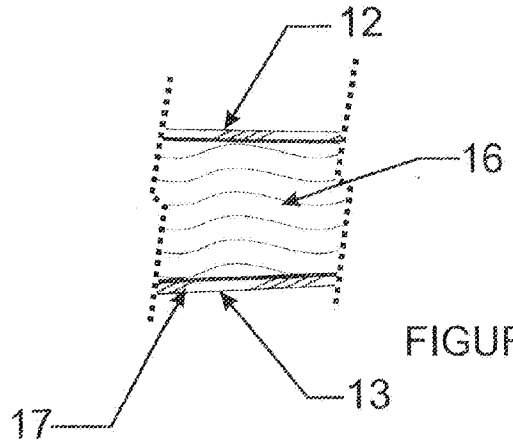
FIG. 1B is a partial sectional view taken along the lines 1B-1B shown in FIG. 1A.
Figure 3:
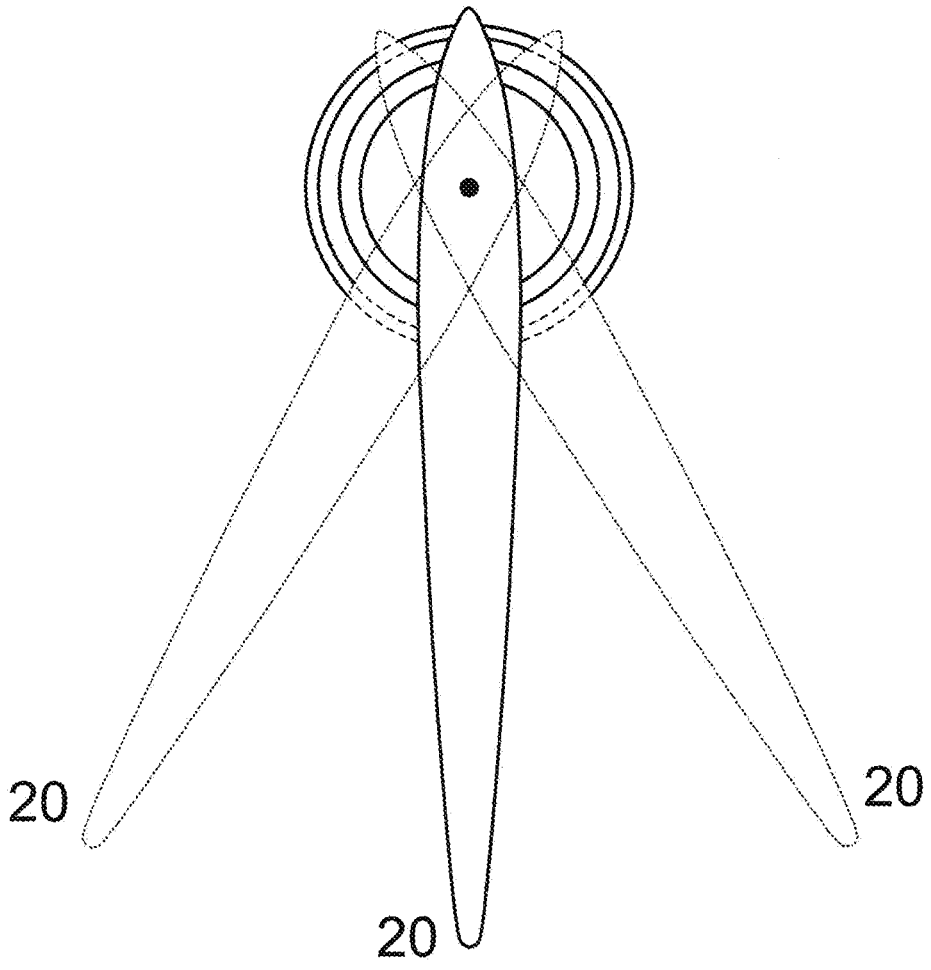
FIG. 3 is a bottom view of the center fin shown in FIG. 2A illustrating rotation of the center fin about an axis.

FIGS. 1 through 15 illustrate details of a surfboard 10 with a center fin assembly 11 embodying features of the invention. With particular reference to FIGS. 1A, 1B and 2A and 2B, the surfboard 10 has an upper surface or deck 12, a lower surface 13, a forward end or nose 14 and an aft end or tail 15. As illustrated in FIG. 1B, the board 10 has a core 16 typically made of polyurethane or expanded polystyrene and an outer shell 17 which is typically made of fiberglass impregnated with a polyester or epoxy resin. As shown more clearly in FIG. 2A, the lower surface 13 of the aft end 15 of the board 10 has an array of three fins 18, 19 and 20 (commonly called a thruster). Side fins 18 and 19 are forward of the central fin 20 and generally toe-in at an acute angle with respect to the centerline 21. The central fin 20 lies along the longitudinal centerline 21 of the board 10 and is pivotally mounted on the lower surface 13 to facilitate manipulation or rotation thereof by a rider on the upper surface 12 as shown in FIG. 3 while riding the board as will be described in more detail hereinafter. The rider manipulates a tiller 22 (with the rider's rear foot) which is indirectly secured to center fin 20 by a two-piece rotatable shaft 23 of center fin assembly 11.

Figure 4:
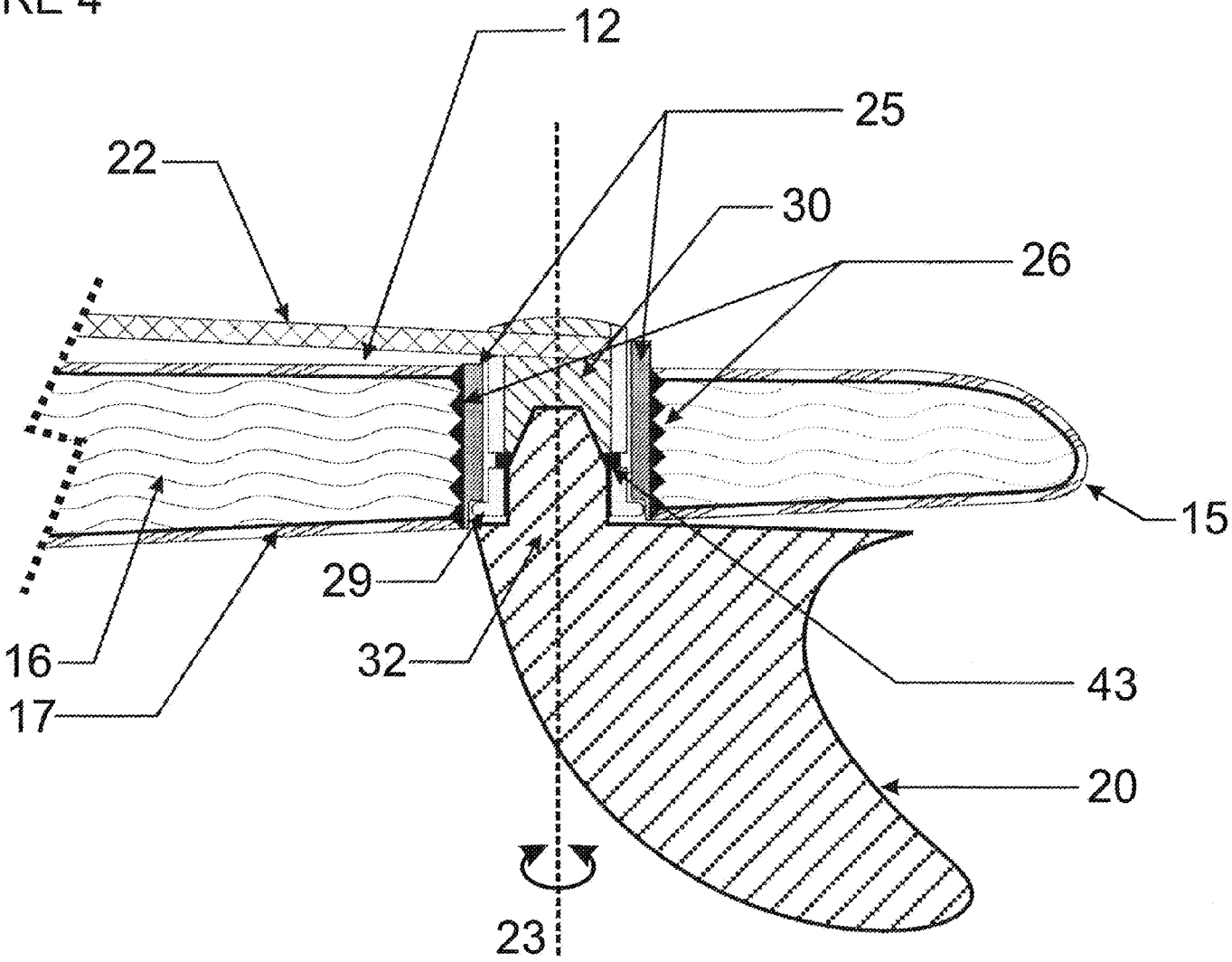
FIG. 4 is a longitudinal cross-sectional view of the aft portion of the surfboard shown in FIG. 1 taken along lines 4-4 illustrating the center fin assembly.
Figure 5:
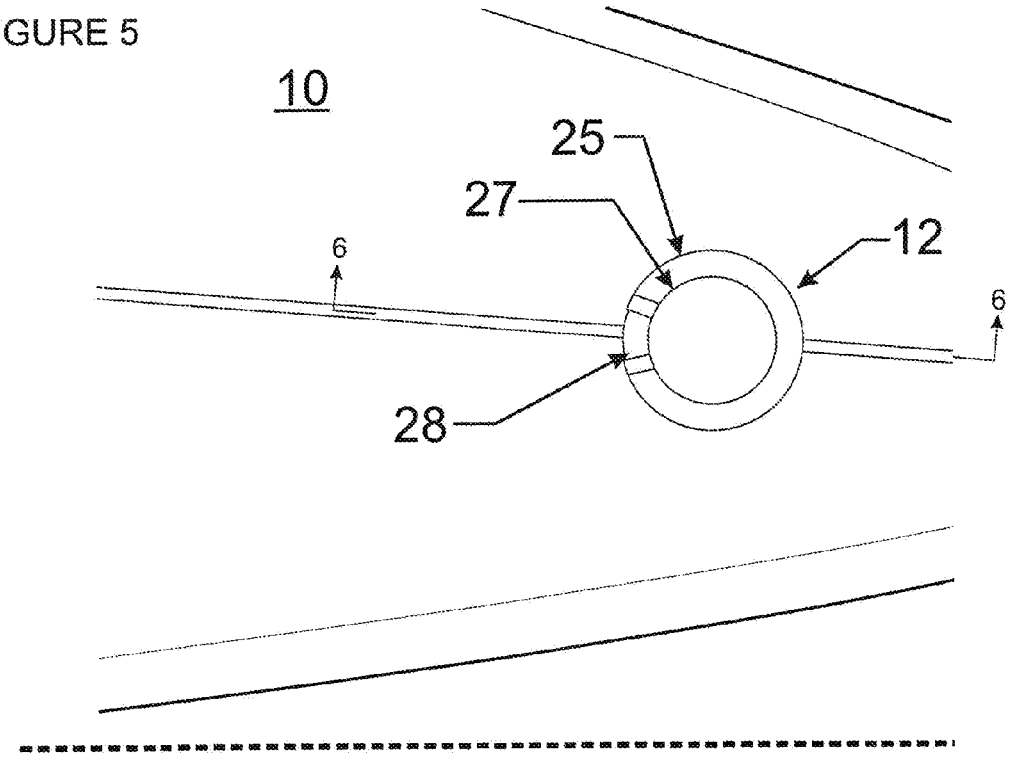
FIG. 5 is a partial top view of the board shown in FIG. 1 with parts removed to illustrate the outer sleeve of the center fin assembly.
Figure 6:
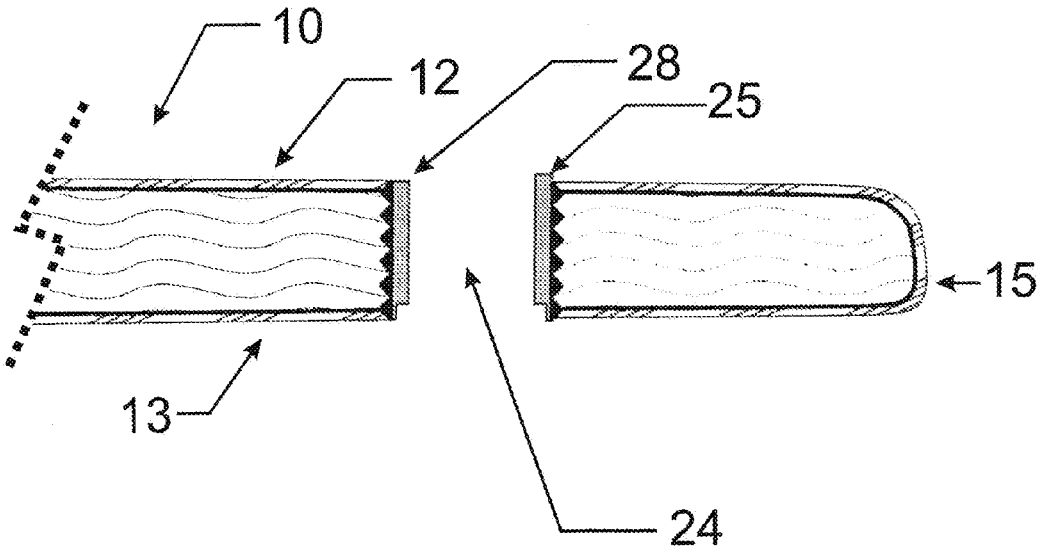
FIG. 6 is a partial longitudinal cross section taken along lines 6-6 shown in FIG. 5.

As shown in FIGS. 4-15, the two-piece rotatable shaft 23 is disposed within a passageway 24 extending through the thickness of board 10. Passageway 24 is lined with an outer sleeve 25 which is secured within the passageway by a suitable adhesive 26, such as high strength epoxy. The forward upper edge 27 of the outer sleeve 25 has a recess 28, as shown in FIGS. 4-6, to allow for movement of the tiller 22 by the rider. The rotatable shaft 23 has a lower shaft portion 29 and an upper shaft portion 30 to facilitate their assembly.

Figure 7:
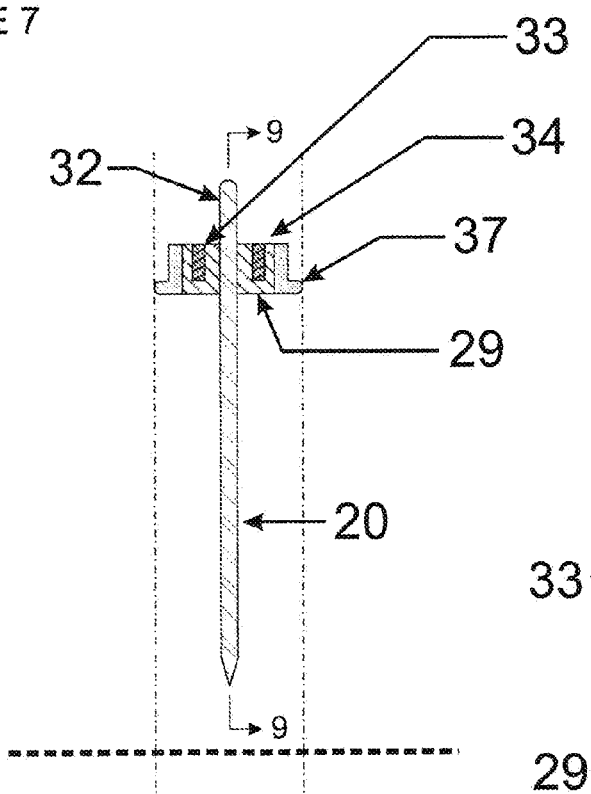
FIG. 7 is a transverse cross section of the central fin and lower shaft portion of the rotatable shaft of the center assembly shown in FIG. 4.
Figure 8:
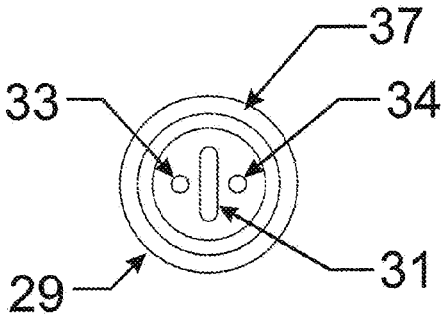
FIG. 8 is a top view of the lower shaft portion shown in FIG. 7 with the center fin removed.
Figure 9:
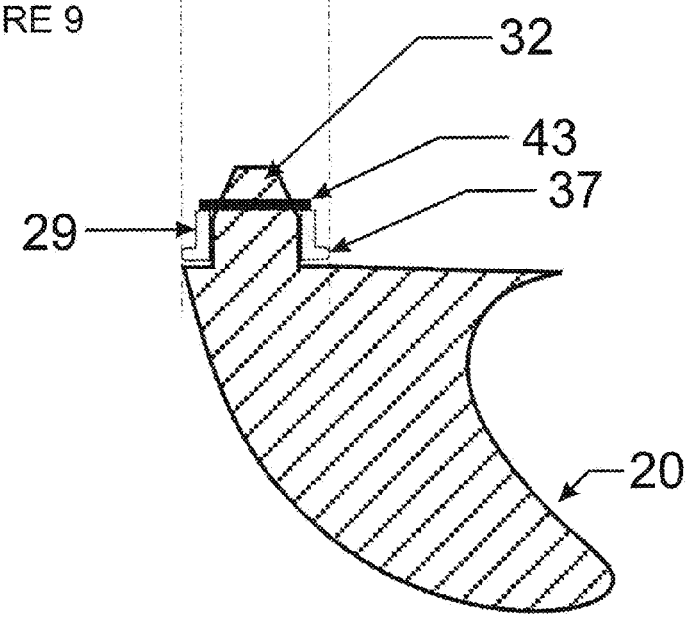
FIG. 9 is a longitudinal cross section of the central fin and lower shaft portion taken along lines 9-9 shown in FIG. 7.

The lower shaft portion 29, as shown best in FIGS. 7-9 has an elongated slot 31 configured to receive tab 32 of center fin 20 which extends beyond the top of the lower shaft portion. Tab 32 may be secured within the slot 31 by a suitable adhesive. The lower shaft portion 29 has a pair of voids 33 and 34 aside the elongated slot 30 configured to receive the tips of screws 35 and 36 which secure the lower and upper shaft portions 29 and 30 together to form the two-piece rotatable shaft 23. The lower edge of the lower shaft portion 29 has a flange 37 which is configured to engage the lower edge of the outer sleeve 25 to position the lower shaft portion 29 within the passageway 24.

Figure 10:
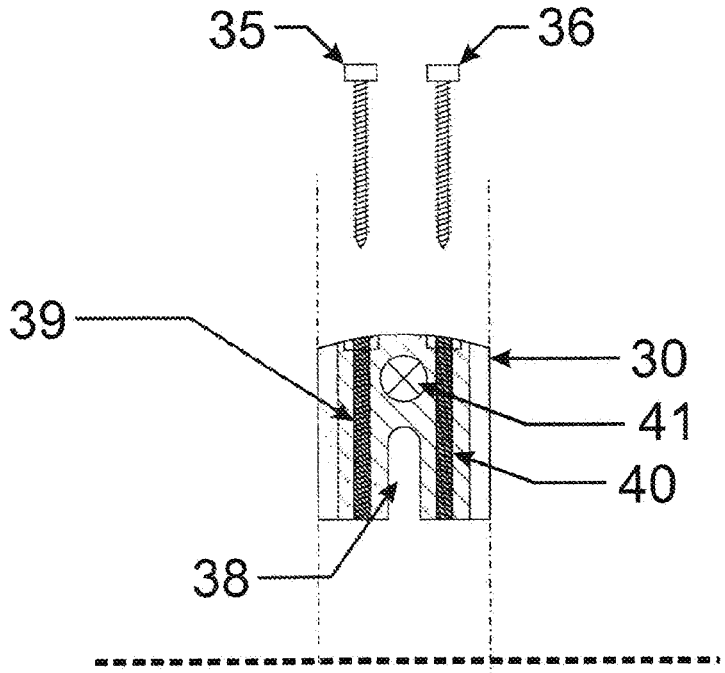
FIG. 10 is a transverse cross section of the upper shaft portion of the center fin assembly shown in FIG. 4.
Figure 11:
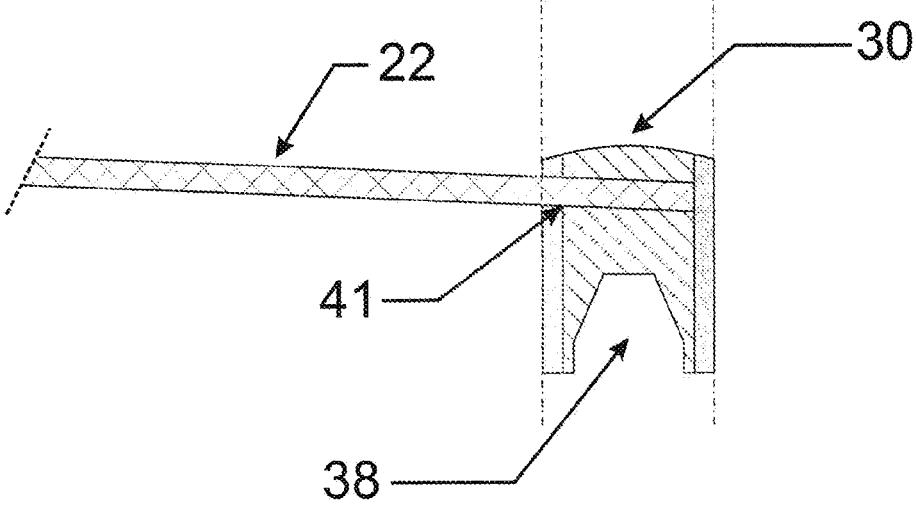
FIG. 11 is a longitudinal cross section of the upper shaft portion of the center fin assembly shown in FIG. 4.

As illustrated in FIGS. 10 and 11, the upper shaft portion 30 has a slotted recess 38 configured to receive the portion of the tab 32 of center fin 20 which extends beyond the top of the lower shaft portion 29, so that rotation of the upper shaft portion causes rotation of the center fin. The upper shaft portion 30 has a pair of predrilled countersunk holes 39 and 40 configured to receive screws 35 and 36 which extend through these holes to and are secured in the voids 33 and 34 in lower shaft portion 29 to secure the lower and upper shaft portions 29 and 30 together to form rotating shaft 23. The upper shaft portion 30 has a hole or recess 41 configured to receive the aft end 42 of tiller 22 and, with a suitable adhesive, secure the aft end to the rotatable shaft 23 so that movement of the upper shaft portion 29 by the tiller will move the central fin 20. The recessed upper edge 28 of outer sleeve 25 receives the tiller 21 and limits the movement thereof.

As shown in FIG. 4, a bushing 43, which may have various thicknesses, may be provided between the upper edge of lower shaft portion 29 and the lower edge of upper shaft portion 30 to adjust the space therebetween and to thereby accommodate surf boards of different thicknesses.

Figures 12, 13:
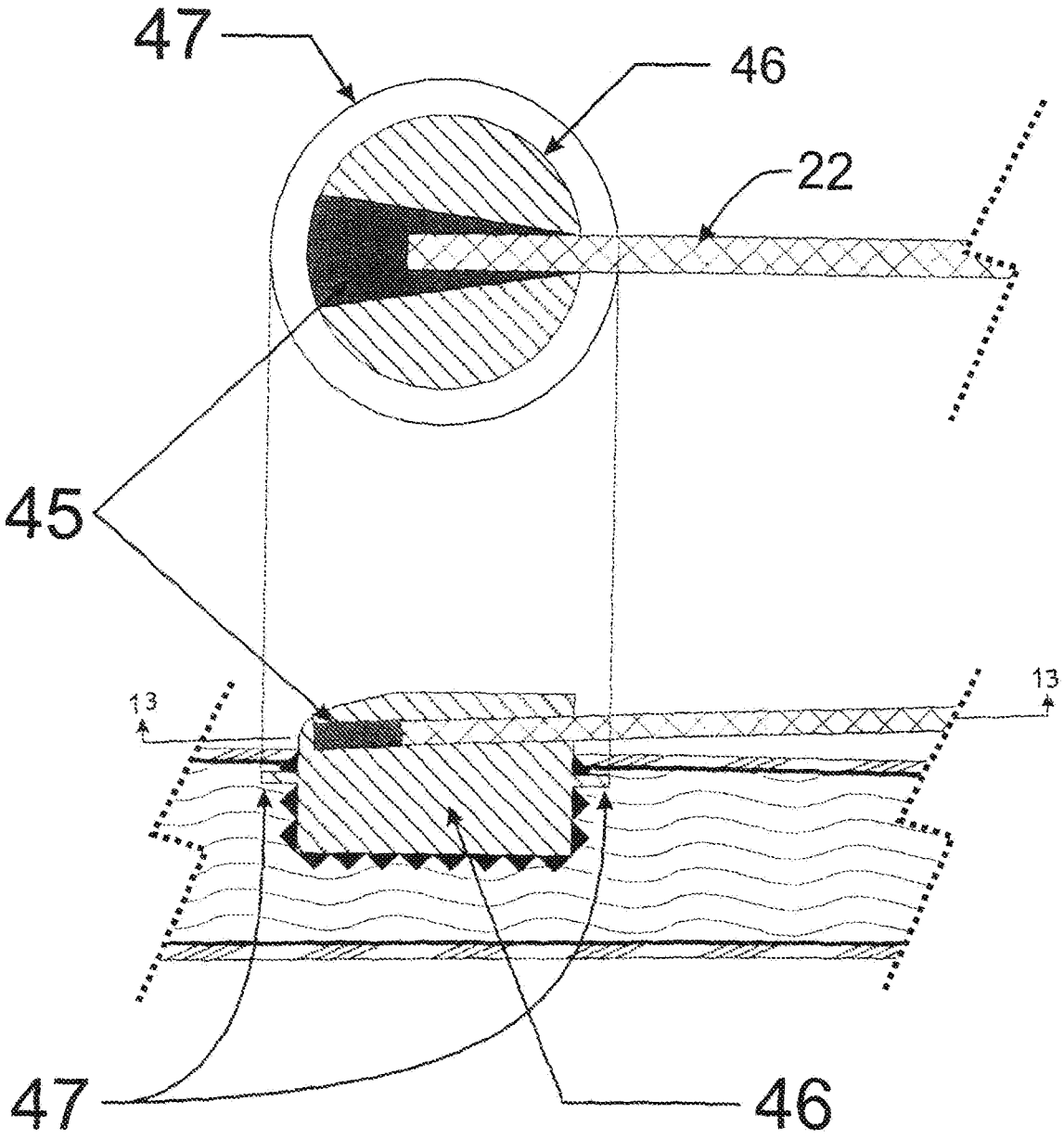
FIG. 12 is a longitudinal cross section taken along lines 12-12 shown in FIG. 1.
FIG. 13 is a cross sectional taken along lines 13-13 shown in FIG. 12.

As shown in FIGS. 12 and 13, the forward end 44 of the tiller 22 is placed within a passageway 45 of node 46 which may be rotatably secured within the deck 12 of the board 10 at the centerline 21 thereof. The node 46 may be rotatably disposed within the deck 12 to allow the forward end 44 of the tiller 22 to move so that the tiller can be arcuately deformed by the rider's foot and thereby rotate the center fin 20. The forward end 44 of the tiller 22 remains within the passageway 45 and is slidable therein during the arcuate deformation. When the rider releases foot pressure from the tiller 22, the tiller and the center fin 20 return to neutral positions along the centerline 21. In this embodiment, the passageway 45 flares outwardly in the forward direction to allow the forward tip of the tiller 22 to freely deform within the passageway when the tiller is deformed by the rider. As shown in FIG. 12, the node 46 has a flange 47 to hold the node within the upper surface 12 yet allow its rotation when the tiller 22 is arcuately deformed by the rider. The flanged node 46 also facilitates the installation and alignment thereof.

Figure 14:
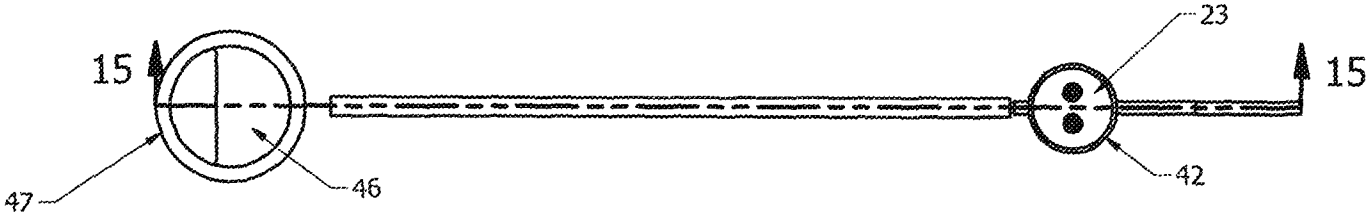
FIG. 14 is a top view of the center fin assembly shown in FIG. 1.
Figure 15:
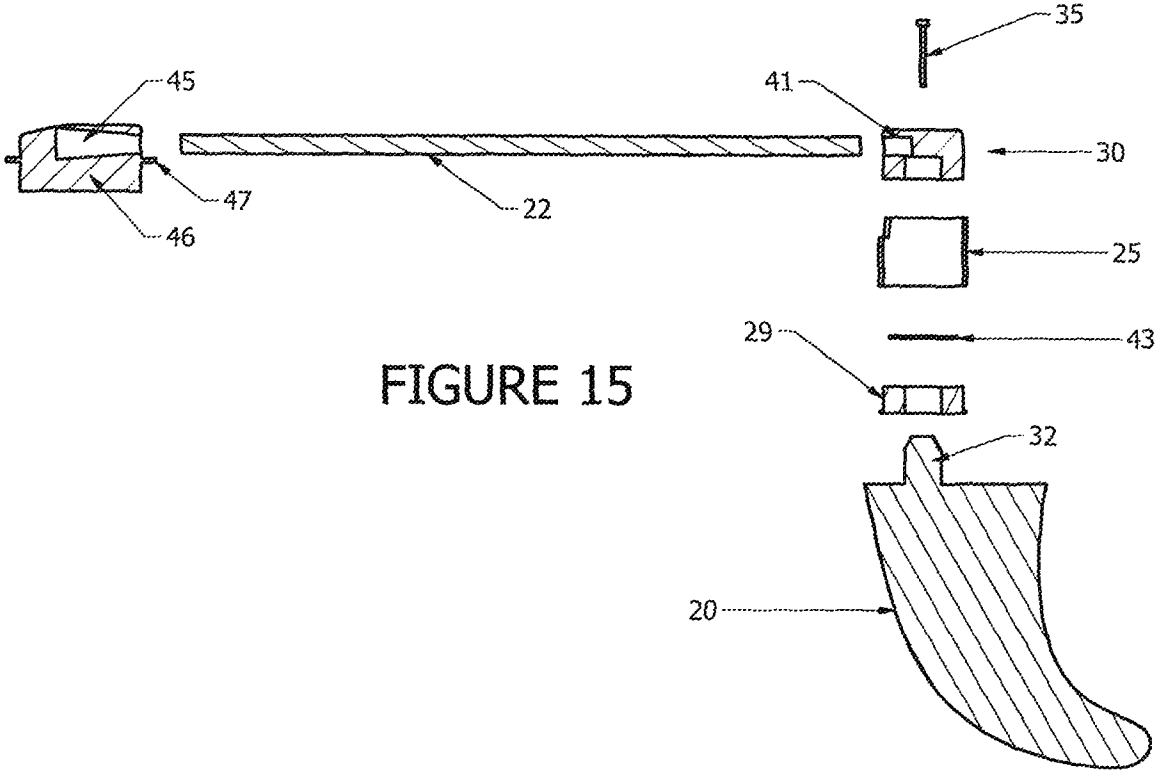
FIG. 15 is an exploded longitudinal cross section of the center fin assembly shown in FIG. 14 taken along lines 15-15 to illustrate the various parts to the center fin assembly.

FIGS. 14 and 15 depict the various elements of center fin assembly 11 in a plan view and an exploded transverse cross-sectional view in elevation.

Figure 16:
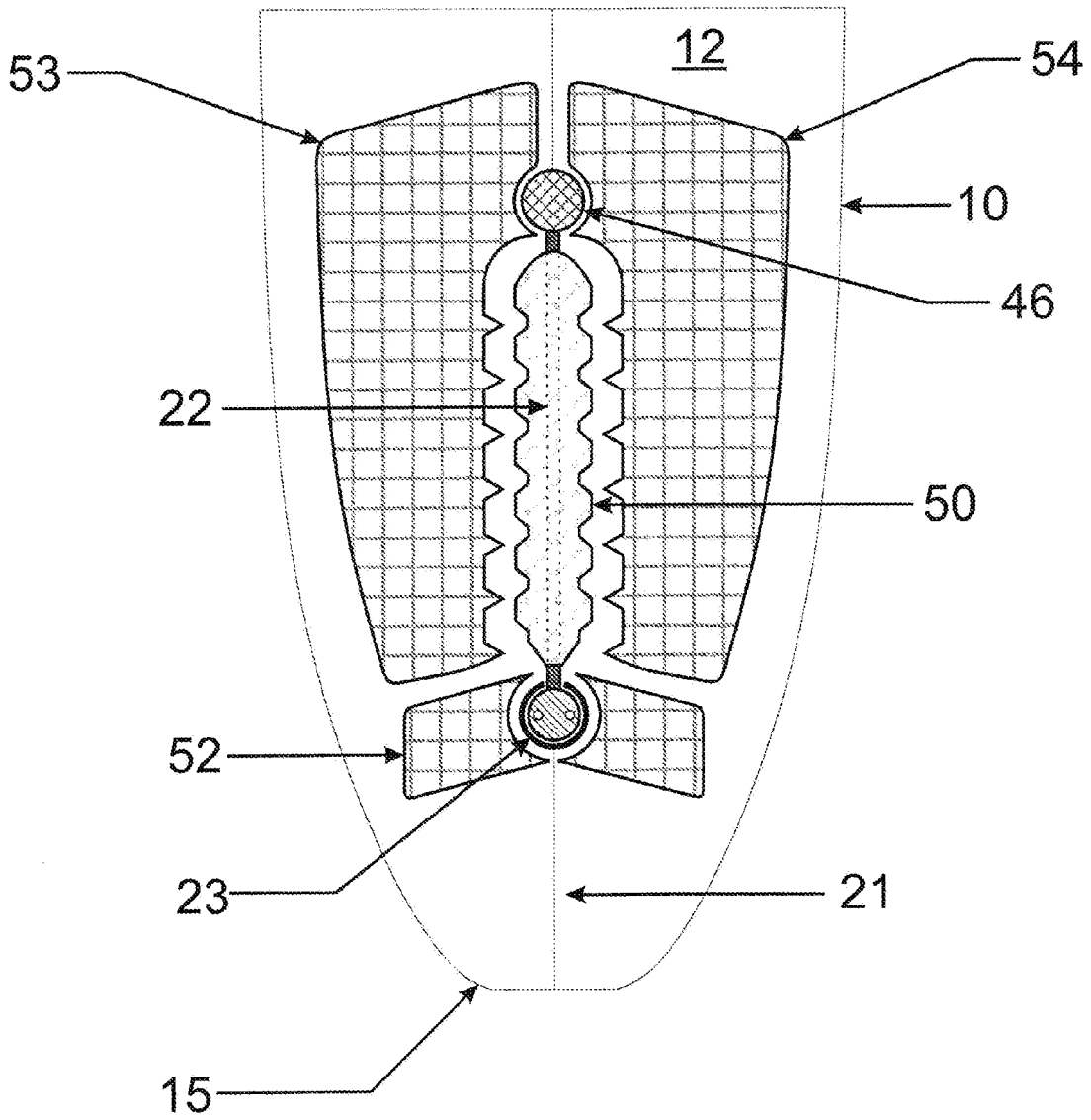
FIG. 16 is a plan view of the aft end of an alternative surf board, illustrating an arch pad which is secured to the tiller and a tail pad and kick pad which are secured to the upper surface of the surf board.

FIG. 16 illustrates further features on the aft portion of the surfboard and particularly the padding which improves traction with the rider's foot when the rider pushes off with the ball or arch of the riders. Arch pad 50 is secured to the tiller 22 to allow the rider's rear foot 51 (shown in phantom) to comfortably straddle the tiller. A kick pad 52, which is typically provided to prevent the rider's rear foot from slipping off the tail of the surfboard, is provided to additionally protect the rider's rear foot from the upper shaft portion 30 which extends above the deck level. Tail pads 53 and 54 are provided on both sides of the tiller 22 to raise the rider's rear foot 51 to a level which is comfortable with the thicker arch pad 50.

The rider will ride the board 10 in a conventional manner but when the rider shifts his or her weight going into a turn, the rider's rear foot which is comfortably position on arch pad 50 will forcefully deflect the tiller 22 in the direction which reinforces the desired board trajectory which in turn rotates the center fin 20 in the desired direction to reinforce the intended board trajectory. When the board rider makes a turn, the rider's weight is shifted to tilt the board in the direction of the desired turn and only two fins, the side fin nearest the rail being tilted downwardly and the center fin are effectively engaged. The present center fin assembly 11 enables the angle of the center fin 20 to be more closely matched to the angle of the toe-in of the side fine and thereby minimize directional friction with the water during a turning maneuver. Thus, there is less loss of speed in the turn due to the rotation of the center fin 20. Moreover, tighter turns and better board control are possible.

The various components of the center fin assembly can generally be made of conventional materials. For example, the lower shaft portion 29 and upper shaft portion 30 may have outer shells of PVC and an inner core of high strength epoxy filler.

Figure 17:
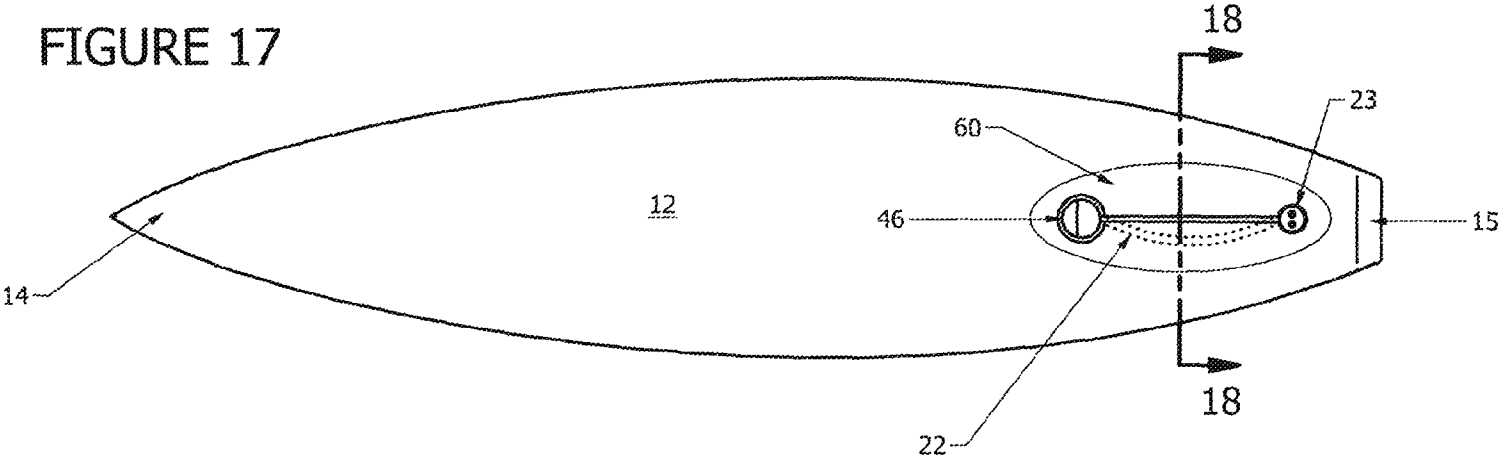
FIG. 17 is a plan view of the aft end of an alternative surf board design which has a recess in the upper surface that receives the center fin assembly embodying features of the invention to reduce the distance a tiller of the assembly extends beyond the upper surface or deck of the surf board.
Figure 18:
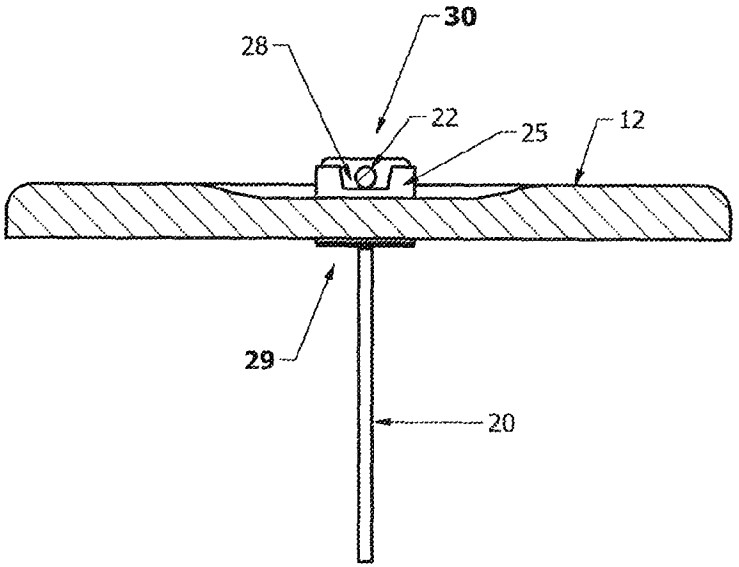
FIG. 18 is a transverse cross-sectional view taken along the lines 18-18 shown in FIG. 17.

An alternative embodiment is shown in FIGS. 17 and 18 which provides an oval recess 60 within the upper surface 13 to lower the tiller 22 and thereby make the tiller more comfortable for the rider and minimize the thickness needed for tail pads 53 and 54. Arcuate deformation of the tiller 22 is shown in phantom.

FIGS. 19 and 20 illustrate another alternative embodiment wherein the bottom edge of outer sleeve 25 is provided with a fin box 65 which fits into a recess within the lower surface 13 of the board 10. The base of center fin 20 then rotates within the box 65 and prevents water flow between the base of the center fin and the lower surface of the board 10.

Figure 21:
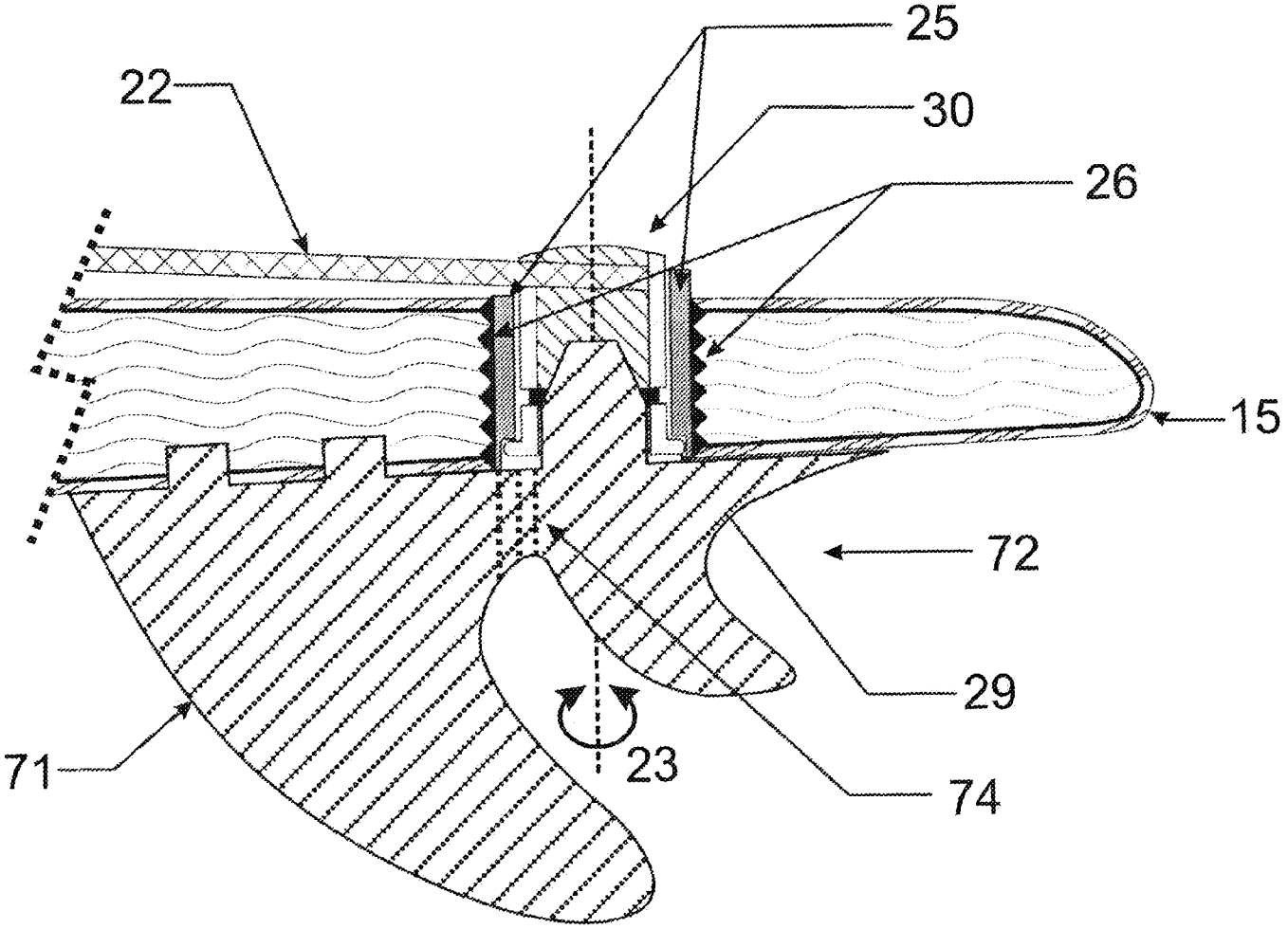
FIG. 21 is a longitudinal cross section of an alternative embodiment in which the center fin has a fixed portion and a rotatable portion aft of the fixed portion.

Another alternative of the center fin assembly is shown in FIG. 21 which a center fin 70 has a forward center fin portion 71 that is fixed to the underside of the board and a separate rotatable aft center fin portion 72 which may be secured to a rotatable shaft 73 as described above. The aft center fin portion 72 is rotated through an angle by the rotatable shaft 73 in the same fashion.

While particular forms of the invention have been illustrated and described herein, it will be apparent that various modifications and improvements can be made to the invention. Additional details of the surfboards and other water sports boards may be found in the patents and applications incorporated herein. To the extent not otherwise disclosed herein, materials and structure may be of conventional design.

Moreover, individual features of embodiments of the invention may be shown in some drawings and not in others, but those skilled in the art will recognize that individual features of one embodiment of the invention can be combined with any or all the features of another embodiment. Accordingly, it is not intended that the invention be limited to the specific embodiments illustrated. It is therefore intended that this invention be defined by the scope of the appended claims as broadly as the prior art will permit.

Terms such as "element", "member", "component", "device", "means", "portion", "section", "steps" and words of similar import when used herein shall not be construed as invoking the provisions of 35 U.S.C §112(6) unless the following claims expressly use the terms "means for" or "step for" followed by a particular function without reference to a specific structure or a specific action. All patents and all patent applications referred to above are hereby incorporated by reference in their entirety.

What is claimed is:

1. A water sports board, comprising:

a. an elongated tapered board having an upper surface and a lower surface and being configured to support a rider on the upper surface; and b. a center fin on the lower surface of the board which has an assembly comprising a flexible tiller on the upper surface of the board, the tiller having a forward end secured at a centerline of the board, the forward end disposed within a rotatable node, and an aft end coupled to the center fin that is manipulatable by the rider on the upper surface to move the center fin about an axis extending through the board and thereby steer the water sports board, wherein the tiller deforms into an arcuate shape when a force is applied by a rider's foot to an intermediate location along a length of the tiller between the forward end and the aft end.

2. The water sports board of claim 1 wherein the center fin assembly has a rotatable shaft extending through the board at an aft location with the center fin secured to the rotatable shaft.

3. The water sports board of claim 2 wherein the tiller is operable by the rider to rotate the rotatable shaft.

4. The water sports board of claim 3 wherein the tiller has an aft end secured to the rotatable shaft so that deformation of the tiller will rotate the center fin.

5. The water sports board of claim 4 wherein the tiller has a forward end pivotally connected to the upper surface of the board to allow the tiller to deform into the arcuate shape when a force is applied by the rider's foot to the intermediate location along the length of the tiller.

6. The water sports board of claim 5 wherein the tiller deformation causes the rotation of the rotatable shaft and the center fin attached thereto and thereby assists the rider in steering the water sports board.

7. The water sports board of claim 1, further comprising an arch pad secured to the tiller at the intermediate location thereon having an upper surface which is configured to be engaged by the rider's foot to provide traction with the rider's foot.

8. The water sports board of claim 2 wherein the rotatable shaft is a two piece shaft with an upper shaft portion and a lower shaft portion which are secured together with the center fin being secured to the lower shaft portion so as to be rotatable therewith.

9. The water sports board of claim 8 wherein the tiller is secured to the upper shaft portion so that movement of the tiller will move the center fin.

10. The water sports board of claim 1 comprising a surfboard.

11. The water sports board of claim 1 including a pair of side fins secured to the lower surface forward of the center fin.

12. The water sports board of claim 11 wherein the side fins toe in toward a center portion of the board.

13. A method of steering a water sports board having an upper surface and a lower surface, the method comprising:

a. providing a center fin assembly including a center fin secured to a rotatable shaft extending through the board, the center fin assembly being operable by a rider on the upper surface to rotate the rotatable shaft and the center fin secured thereto about an axis orthogonal to the board, a flexible tiller on the upper surface of the board, the tiller having a forward end secured at a centerline of the board, the forward end disposed within a rotatable node, and an aft end coupled to the center fin that is manipulatable by the rider on the upper surface, wherein the tiller deforms into an arcuate shape when a force is applied by a rider's foot to an intermediate location along a length of the tiller between the forward end and the aft end to move the center fin about the axis extending through the board and thereby steer the water sports board, and an arch pad secured at an intermediate location along a length of the tiller configured to be engaged by the rider's foot to straddle the tiller; and b. operating the center fin assembly to move the rotatable shaft by the rider on the upper surface of the water sports board so as to rotate the center fin and thereby steer the board.

14. The method of claim 13 wherein the tiller has a forward end that is pivotally mounted to the upper surface of the water sports board and an aft end secured to the rotatable shaft so that a force applied to the intermediate location on the tiller will move the center fin about the axis.

15. The method of claim 14 wherein the arch pad mounted to the intermediate location on the tiller allows the rider to place his or her foot to engage the tiller and adjust the position of the center fin by applying a force to the intermediate location on the tiller.

16. A center fin assembly for a water sports board having upper and lower surfaces, the assembly comprising:

a. a rotatable shaft configured to extend through a passageway in an aft location of the water sports board and having an upper shaft portion and a lower shaft portion;

b. a center fin which is configured to be secured to the lower shaft portion;

c. an elongated flexible tiller on the upper surface of the board having an aft end configured to be secured to the upper shaft portion so as to allow the elongated tiller to rotate the rotatable shaft to rotate the center fin, the tiller having a forward end secured at a centerline of the board, the forward end disposed within a rotatable node, wherein the tiller deforms into an arcuate shape when a force is applied by a rider's foot to an intermediate location along a length of the tiller between the forward end and the aft end to rotate the rotatable shaft; and d. an arch pad secured at the intermediate location along a length of the tiller configured to be engaged by a rider's foot to straddle the tiller.

17. The center fin assembly of claim 16 wherein the forward end of the elongated tiller is configured to be pivotally secured to the upper surface of the water sports board so that the tiller deforms into the arcuate shape when a force is applied to the intermediate location along the length of the tiller by the rider positioned on an upper surface of the water sports board.

18. The center fin assembly of claim 17 wherein the node is configured to be rotatably mounted within the upper surface of the water sports board and is configured to receive the forward end of the tiller to effect pivotal movement thereof.

19. A center fin assembly for a water sports board having upper and lower surfaces, the assembly comprising:

a. a rotatable shaft configured to extend through a passageway in an aft location of the water sports board and having an upper shaft portion and a lower shaft portion;

b. a center fin which is configured to be secured to the lower shaft portion;

c. a flexible tiller on the upper surface of the board, the tiller having a forward end secured at a centerline of the board, the forward end disposed within a rotatable node, and an aft end configured to engage the upper shaft portion to rotate the rotatable shaft to rotate the center fin, wherein the tiller deforms into an arcuate shape when a force is applied by a rider's foot to an intermediate location along a length of the tiller between the forward end and the aft end to rotate the upper shaft portion; and d. an arch pad secured at an intermediate location along a length of the tiller configured to be engaged by the rider's foot to straddle the tiller.

20. The center fin assembly of claim 19 wherein the tiller comprises an elongated tiller having an aft end secured to the upper shaft portion.

21. The center fin assembly of claim 19 including an outer sleeve configured to be secured within the passageway and to rotatably receive the rotatable shaft.

22. The center fin assembly of claim 19 wherein the center fin has an upwardly projecting tab that extends through a slot in the lower portion of the rotatable shaft and into a recess in the upper shaft portion.

23. The center fin assembly of claim 22 wherein the upper and lower shaft portions are secured together by a pair of elongated securing elements.

24. The center fin assembly of claim 23 wherein the elongated securing elements are on opposite sides of the recess and slot that receive the upwardly projecting tab of the center fin.

25. A steerable water sports board, comprising:

a. an elongated tapered board having an upper surface and a lower surface and being configured to support a rider on the upper surface;

b. a pair of side fins on the lower surface of the board spaced away from a center line of the board and angled in a forward direction toward the center line; and c. a center fin on the lower surface of the board which has an assembly that is manipulatable by the rider on the upper surface to rotate the center fin about an axis extending through the board and passing through the center line of the board to thereby align the center fin more closely to one of the side fins to facilitate steering the water sports board, wherein the center fin assembly comprises a flexible tiller on the upper surface of the board, the tiller having a forward end secured at the center line of the board, the forward end disposed within a rotatable node, and an aft end configured to rotate the center fin and an arch pad secured at an intermediate location along a length of the tiller configured to be engaged by a rider's foot to straddle the tiller, and wherein the tiller deforms into an arcuate shape when a force is applied by the rider's foot to the arch pad at the intermediate location along the length of the tiller to rotate the center fin about the axis.

* * * * *